United States Patent [19]

Nystuen

[11] Patent Number: 4,691,721

[45] Date of Patent: Sep. 8, 1987

[54] VOLUMETRIC GRAVITY FEED LIQUID DISPENSER

[75] Inventor: David L. Nystuen, Bloomington, Minn.

[73] Assignee: Ecolab Inc., St. Paul, Minn.

[21] Appl. No.: 679,259

[22] Filed: Dec. 7, 1984

[51] Int. Cl.[4] ..... B08B 13/00

[52] U.S. Cl. ..... 134/96; 222/453; 134/100

[58] Field of Search ..... 134/93, 100, 101, 96; 222/57, 67, 453

[56] References Cited

U.S. PATENT DOCUMENTS

| | | | |
|---|---|---|---|
| 883,289 | 3/1908 | Burg | 222/67 X |
| 1,825,039 | 9/1931 | Aspden | 222/69 |
| 1,871,175 | 8/1932 | Grunwald | 222/453 |
| 2,039,624 | 5/1936 | Bigelow | 222/453 X |
| 2,226,096 | 12/1940 | Halsey . | |
| 2,243,188 | 5/1941 | Biach | 222/67 X |
| 2,313,846 | 3/1943 | Tamminga | 222/453 X |
| 2,573,787 | 11/1951 | de Ganahl et al. . | |
| 2,587,388 | 2/1952 | Ryder, Jr. | 222/67 X |
| 2,671,037 | 3/1954 | Stoddard . | |
| 2,972,434 | 2/1961 | James | 222/67 X |
| 2,991,911 | 7/1961 | Spain . | |
| 3,073,490 | 1/1963 | Dahl et al. . | |
| 3,094,245 | 6/1963 | Mizuno . | |
| 3,142,416 | 7/1964 | Federighi . | |
| 3,254,797 | 6/1966 | Porter . | |
| 3,341,074 | 9/1967 | Pannutti | 222/57 |
| 3,517,862 | 6/1970 | Bianco | 222/453 X |
| 3,565,290 | 2/1971 | Prussin et al. | 222/57 |
| 3,638,833 | 2/1972 | Lucas . | |
| 3,727,632 | 4/1973 | Pansini | 222/67 X |
| 3,731,845 | 5/1973 | Booth | 222/67 |
| 3,739,942 | 6/1973 | Mercer et al. | 222/453 X |
| 3,774,808 | 11/1973 | La Vange . | |
| 3,818,924 | 6/1974 | Carlyle | 222/57 X |
| 3,841,524 | 10/1974 | Easter . | |
| 3,907,173 | 9/1975 | Lind | 222/57 X |
| 4,116,128 | 9/1978 | Lehmann et al. | 222/67 |
| 4,429,809 | 2/1984 | Bousgarbies | 222/67 |

FOREIGN PATENT DOCUMENTS 1548940 4/1965 Fed. Rep. of Germany .

*Primary Examiner*—Harvey C. Hornsby
*Assistant Examiner*—Frankie L. Stinson
*Attorney, Agent, or Firm*—Merchant, Gould, Smith, Edell, Welter & Schmidt

[57] ABSTRACT

A liquid dispenser (10) for dispensing a volumetric quantity of liquid (26) is disclosed. The dispenser (10) includes a plunger (11) having a longitudinal axis (30). First and second umbrella seals (14) and (15) are cooperatively connected to the plunger (11). The seals (14) and (15) are in spaced relationship. A plunger housing (16) encloses at least a portion of the plunger (11). The plunger housing (16) is adapted for relative movement with the plunger (11) along the longitudinal axis (30). The plunger housing (16) has an inner cavity (19*a*) having a first opening (19*b*) and a second opening (19*c*), wherein a measuring chamber is defined between the seals. Relative movement along the longitudinal axis (30) is effected between the plunger (11) and the plunger housing (16), wherein the plunger (11) moves from a filling to a dispensing position. When in the filling position, the second seal (15) seals the second opening 19(*c*) and the first seal (14) allows liquid (26) to enter the measuring chamber (19*a*) through the first opening (19*b*). When in the dispensing position, the first seal (14) seals the first opening (19*b*) and the second seal (15) allows liquid (26) to be dispensed by gravity from the second opening (19*c*). The first seal (14) always is in a sealing relationship to the first opening (19*b*) when the second seal (15) allows dispensing of the liquid (26), whereby a constant volume of liquid (26) is dispensed.

1 Claim, 4 Drawing Figures

VOLUMETRIC GRAVITY FEED LIQUID DISPENSER

BACKGROUND OF THE INVENTION

1. Field of the Invention

This invention relates generally to liquid dispensers and more particularly to liquid dispensers that are activated by the rise and fall of a level of water in a reservoir or cup of an apparatus during the spray action of the wash arm of a dishwasher.

2. Description of the Prior Art

Domestic dishwashing machines are typically supplied with a rinse additive by one of two means. The first is through a solid rinse additive that is eroded during a dispensing cycle of the dishwashing machine, thereby providing a rinse additive solution to the water in the dishwashing machine. Other domestic washing machines, typically the top of the line models, have a build-in liquid rinse additive dispenser. The rinse additive dispenser is wired to a timer in the dishwashing machine to inject a pre-set amount of liquid rinse additive into the final rinse to minimize spotting and enhance drying.

The liquid rinse dispensers may fail after several years of use. In high/hard solids water, the user may notice a deterioration of the washing results immediately, but in softer waters, it may take a number of cycles for the deterioration of results to show up when the dispenser fails. As a result, many rinse additive injectors are neglected, resulting in the rinse additive not being added to the dishwashing machines with the resultant increase in spotting and harder drying. Further, it is costly to have a repairman come into the house to service the malfunctioning dispenser, so often the use of the liquid rinse additive dispensers are discontinued by many users.

To date, applicant is unaware of any liquid dispensers for a rinse additive for retrofitting of a dishwashing machine not furnished with a build-in dispenser. In U.S. Pat. No. 2,226,096, issued Dec. 24, 1940 to N. W. Halsey, a detergent dispenser for washing machines is disclosed. The detergent dispenser is activated by the water in the washing machine. However, the dispenser is not adapted for repetitive dispensing of detergent without refills after each use.

In a non-related field, that of dispensing a concentrated liquid into a tank of a toilet, dispensers are used to repeatedly dispense a small level of liquid with each flush of the toilet. One example of such a dispenser is seen in U.S. Pat. No. 3,841,524, issued Oct. 15, 1974 to Avard Easter. The automatic liquid dispenser is for an inverted bottle of concentrated liquid. The dispenser has a top seal and a bottom seal, such that when the float is lowered the bottom seal opens, allowing the liquid within a hollow member to be dispensed. At the same time, the top seal is closing, preventing additional liquid from entering into the hollow member. The top seal and bottom seal are formed with plugs that are presumably solid and inflexible. Such a construction allows the opportunity for the product to flow through the dispenser just as the bottom seal is being released and the top seal has not yet completely been sealed off at the top. Therefore, it is not a completely accurate charge of product that is dispensed with each cycle.

The present invention addresses the problems associated with the prior art devices and provides for a gravity feed liquid dispenser that accurately discharges a set volume of product with each dispensing cycle of the dispenser.

SUMMARY OF THE INVENTION

The present invention provides a liquid dispenser for dispensing a volumetric quantity of liquid. The dispenser includes a plunger having a longitudinal axis. First and second umbrella seals are provided and are cooperatively connected to the plunger. The seals are in a spaced relationship to one another. A plunger housing encloses at least a portion of the plunger. The plunger housing is adapted for relative movement with the plunger along the longitudinal axis. The plunger housing has an inner cavity having a first and second opening. The seals are positioned in the inner cavity, wherein a measuring chamber is defined between the seals. The first opening is in fluid communication with the liquid to be dispensed with the first seal controlling fluid communication between the first opening and the measuring chamber. The second seal controls the fluid communication between the measuring chamber and the second opening.

Means for effecting relative movement along the longitudinal axis between the plunger and plunger housing is also provided, wherein the plunger moves from a filling position to a dispensing position. When in the filling position, the second seal seals the second opening and the first seal allows liquid to enter the measuring chamber through the first opening and when in the dispensing position the first seal seals the first opening and the second seal allows liquid to be dispensed by gravity from the second opening. The first seal is always in a sealing relationship to the first opening when the second seal allows dispensing of liquid, whereby a constant volume of liquid is dispensed. In a preferred embodiment, the means for effecting relative movement includes a float cooperatively connected to the plunger and a housing surrounding the float. The housing fills up with water from the spray action of the dishwasher, causing the float to rise and dispense the liquid. As the water later drains out of the housing, the float lowers, thereby recharging the measuring chamber.

DESCRIPTION OF THE PREFERRED EMBODIMENT

Figure 1:
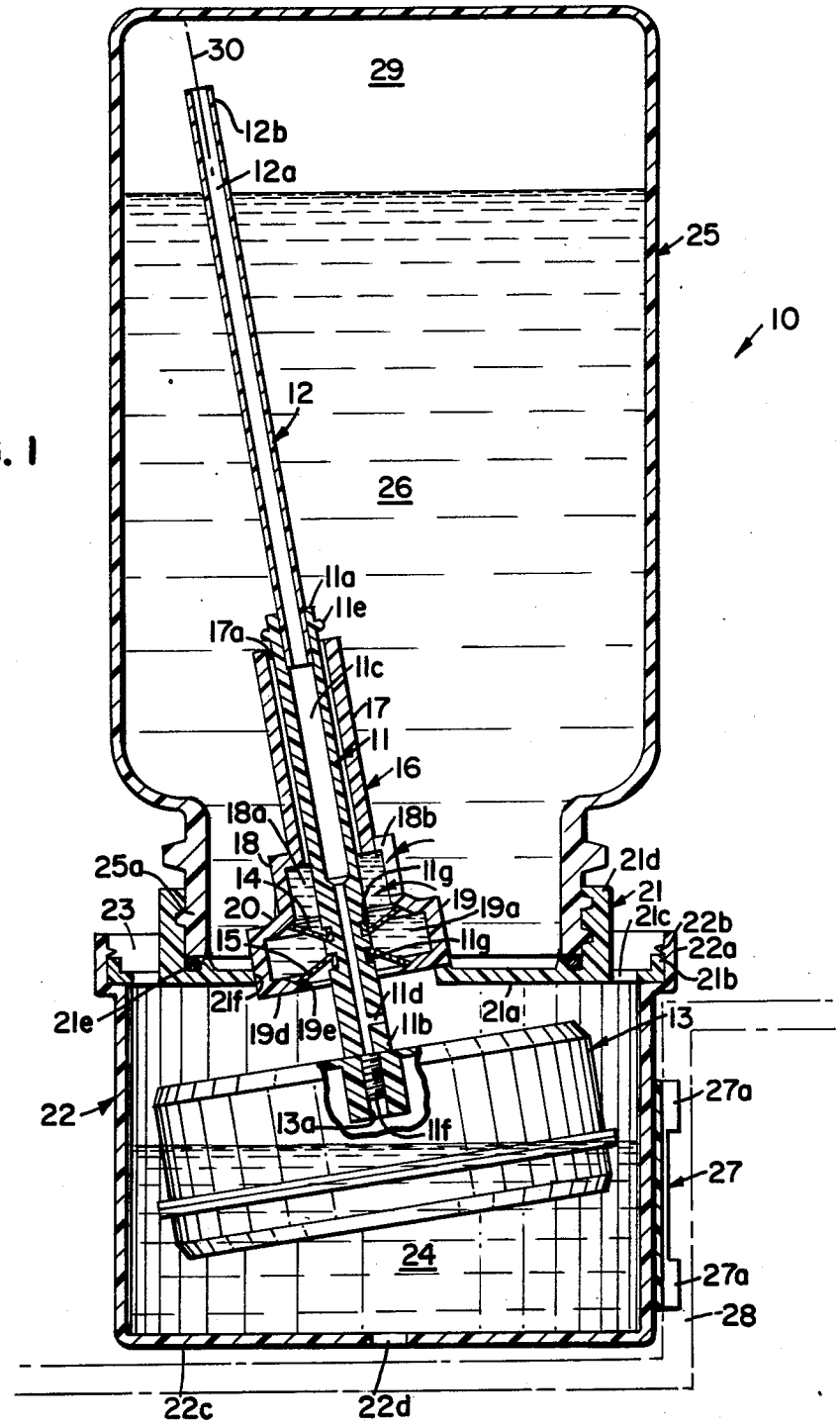
FIG. 1 is a cross-sectional view of the dispenser incorporating my present invention shown in an intermediate mode.

Referring to the drawing, wherein like numerals represent like parts throughout the several views, there is generally disclosed at 10, a volumetric liquid dispenser. The dispenser 10 includes a plunger 11 having a top end 11*a* and a bottom end 11*b*. A bore 11*c* extends through the interior of the plunger 11. As will be more fully described hereafter, the bore 11*c* is a portion of the venting system of the liquid dispenser 10. While the bore 11*c* is shown to have a narrower diameter at its bottom end, it is understood that any suitable configuration will suffice as long as it provides an air passageway.

At the bottom end of the bore 11*c*, an extension opening 11*d* places the bore 11*c* in communication with atmospheric air. A venting tube 12 having a bore 12*a* extending throughout its length is cooperatively connected to the top end of the plunger 11*a*, thereby forming an air passageway from the top end 12*b* of the vent tube through the bore 12*a*, bore 11*c* and the extension opening 11*d*. While it is understood that the venting tube 12 may have any number of suitable outer configurations, a preferred method of cooperatively connecting the venting tube 12 to the plunger 11 is to have a cylindrical venting tube having an outer diameter slightly larger than the inner diameter of the bore 11*c*. The venting tube is made of a plastic material that is slightly deformable so that a press fit is secured when the venting tube 12 is inserted into the bore 11*c* at the top end 11*a* of the plunger 11. This provides for a liquid tight seal between the venting tube 12 and plunger 11. A stop ring 11*e* is cooperatively connected, and in a preferred embodiment integrally molded in the plunger 11. As will be discussed more fully hereinafter, the stop 11*e* limits the travel of the plunger 11.

Cooperatively connected to the bottom end 11*b* of the plunger 11 is a float 13. The float 13 may be sized to give the desired buoyant force that is required for a specific configuration of the liquid dispenser 10. One method of securing the plunger 11 to the float 13 is to simply have the bottom end 11*b* of the plunger 11 threaded. The threads 11*f* are mated with a threaded opening 13*a* of the float 13 to secure the plunger 11 to the float 13. While in the preferred embodiment, a float 13 is used for providing relative movement of the plunger 11 and plunger housing 16, it is understood other means may be used, such as a solenoid.

Figure 4:
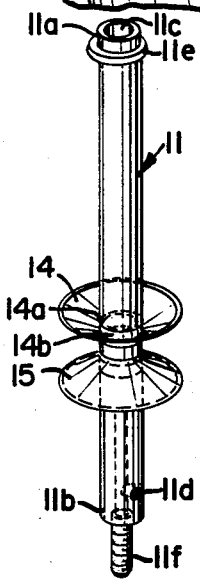
FIG. 4 is a perspective view of the seals and plunger of the dispenser of FIG. 1.

The plunger 11 has a pair of annular grooves 11*g* that extend around the outer periphery of the plunger 11. A first seal 14 is cooperatively connected around the plunger 11 and is positioned in the annular groove 11*g*. A second seal 15 is similarly cooperative-ly connected around the plunger 11 and positioned in the annular groove 11*g*. Both seals 14 and 15 are similar, the only difference being their orientations. FIG. 4 is a perspective view showing the seals 14 and 15. The seals 14 and 15 are umbrella seals and are formed from an elastomer, such as silicone rubber. The umbrella seals have an opening 14*a* in their center. The diameter of the opening 14*a* is smaller than the diameter of the plunger where it is secured, e.g. at the groove 11*g*. To cooperatively connect the seal to the plunger 11, it is simply a matter of stretching the opening 14*a* sufficient to go around the outer diameter of the plunger 11 and the seal is then brought down to the location of the groove 11*g*. Since the diameter of the opening 14*a* is smaller than that of the diameter of the plunger at the groove 11*g*, a seal is formed between the seal 14 and plunger 11. Further, the width of the groove 11*g* may be sized so that the excess material adjacent the opening 14*a*, due to the smaller diameter, forms a cylindrical portion 14*b* which fills the width of the groove 11*g* to further effect a seal between the seal 14 and plunger 11. The orientation of the seal 14 is such that the outer periphery of the seal 14 extends up and away from the groove 11*g*. The seal 15 is similarly cooperatively connected to the plunger 11 except the orientation is reversed. That is, the outer periphery of the seal 15 extends down and away from the second groove 11*g*.

The liquid dispenser 10 includes a plunger housing, generally designated at 16. While it is understood that the plunger housing may embody various configurations, in a preferred embodiment, the plunger housing 16 comprises three concentric cylinders to form the plunger housing 16. The first cylinder 17 has an interior bore 17*a* that is configured to match the outer configuration of the plunger 11. The first cylinder 17 acts as a guide for the relative movement between the plunger 11 and plunger housing 16. Unlike prior art spool design dispensers, there is no need for a close tolerance between the first cylinder 17 and the plunger 11. There does not have to be a liquid tight seal between the first cylinder 17 and the plunger 11. Therefore, it is easier to construct the present invention without the necessity of close tolerances in the manufacture of the first cylinder 17 and plunger 11.

Depending on the viscosity of the product to be dispensed, the temperature and other factors, the spool design dispensers may need a relatively tight clearance between the plunger and spool to effect a seal. In the present invention such close tolerances are not required.

Also, a liquid-tight fit between plunger and cylinder would cause increased friction during movement, thereby adding a problem to the gravity operation concept. Increased friction could be overcome by increasing the weight of the plunger mechanism, but this would require a larger float to attain the needed buoyancy.

A second cylinder 18 is cooperatively connected to the first cylinder 17. The second cylinder 18 has an inner cavity 18*a*. One or more slots 18*b* are provided in the cylinder walls of the cylinder 18 to place the inner cavity 18*a* of the second cylinder 18 in fluid communication with the liquid 26 that is to be dispensed.

A third cylinder 19 is cooperatively connected to the second cylinder 18. A conical shaped intermediate member 20 cooperatively connects the top of the third cylinder 19 to the bottom of the second cylinder 18. The conical member 20 has an inner sealing surface 20*a*. The third cylinder 19 has an inner cavity 19*a* that has an opening 19*b* at its top and an opening 19*c* at its bottom. The third cylinder 19 has a bottom member 19*d* having a conical sealing surface 19*e*. It is understood that the outer and inner configuration of the first, second and third cylinders need not be cylinders, as any other suitable configuration may be used.

The plunger housing 16 is cooperatively connected to an adapter, generally designated at 21. The adapter 21 has a base plate 21*a* having an upwardly extending lip 21*b* and an opening 21*f*. A plurality of openings 21*c* are spaced around the outer periphery of the base plate 21*a*. A threaded collar 21*d* is cooperatively connected to the base plate 21*a*. In a preferred embodiment, the adaptor 21 is constructed of plastic and is of a one piece design. The plunger housing 16 is cooperatively connected to the adapter 21 through the opening 21*f* by any suitable means, such as an ultrasonic welding. The connection between the opening 21*f* and the plunger housing 16 is liquid tight. Similarly, the plunger housing 16 is of a one piece plastic construction in a preferred embodiment.

A housing 22, in the general shape of an open topped cylinder is secured to the adapter 21 by any suitable means. In a preferred embodiment, the housing 22 has an upwardly extending lip 22*a* having a boss 22*b* extending around its inner circumference. The housing 22 is then simply snap fitted over the lip 21*b* of the adapter 21 to secure the housing 22 to the adapter 21. An annular groove 23 is formed between the threaded collar 21*d* and the lip 22*a*. The housing 22 has a bottom member 22c having an opening 22d. As will be more fully described hereinafter, water from the dishwater enters the inner cavity of the housing 22 by means of the plurality of holes 21c. The water 24 enters faster through the holes 21c than it discharges through the opening 22d, thereby causing the level of water 24 to accumulate in the interior of the housing 24 when there is water being sprayed in the dishwasher. A bottle 25 containing the product 26 to be dispensed has a threaded collar 26a. The collar 26a is simply threaded onto the collar 21d of the adapter 21 to secure the bottle 25 to the adapter 21.

A clip 27 having a general cylindrical flange 27a at its top end and bottom end is cooperatively connected to the housing 22. The cylindrical flange 27a has an opening that is adapted to having a snap set over a wire member 28 shown in phantom of a dishwashing rack in a dishwasher.

Figure 2:
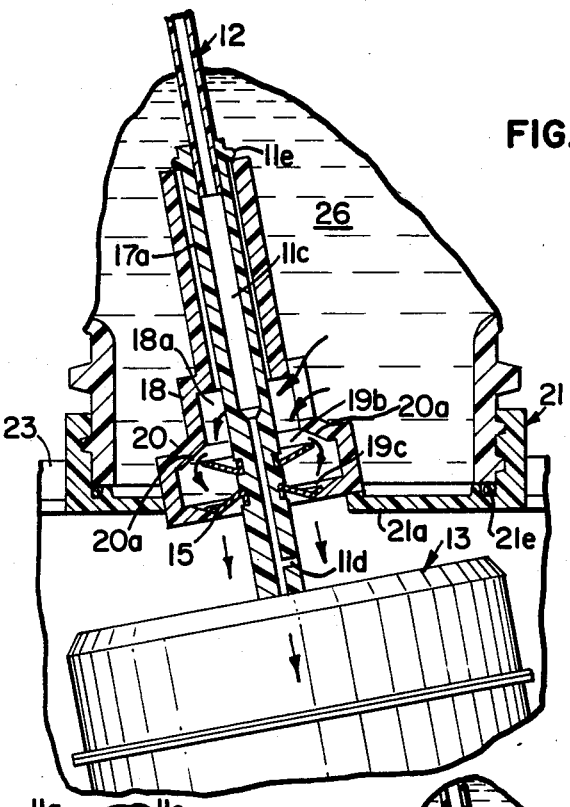
FIG. 2 is a partial cross-sectional view of the dispenser of FIG. 1, shown in the filling mode.

In operation, the product 26 to be supplied is contained in the bottle 25. Typically, the bottle 25 will have a screw-type cover that is secured to the threaded collar 25a. The cover is removed. The adapter and housing assembly are inverted from their positions shown in the drawing and the supply bottle is threaded onto the adapter 21. The liquid dispenser 10 is then inverted to the position shown in the drawings. Initially, the product 26 does not completely fill the bottle 25. This allows for an initial air supply 29 to be in the bottle before the first dispensing cycle. The liquid dispenser 10 is then placed in the dishwasher in a location where the water from the spray arm of the dishwasher will allow water to enter the annular groove 23 and hence, the interior of the housing 22. When the dispenser 10 is first placed in the dishwasher, there will be no water in the housing 22, therefore gravity will pull the float 13 to its lower position, as shown in FIG. 2. The movement of the float 13 along the longitudinal axis 30 causes relative movement between the plunger 11 and plunger housing 16. This lower position, shown in FIG. 2 is when the liquid dispenser 10 is in its filling position. In the filling position, the product 26 that has entered the inner cavity 18a through slots 18b flows through the opening 19b and into the inner cavity 19a. The top seal 14 is moved away from the sealing surface 20a, thereby allowing the product to pass into the inner cavity 19a. The lower umbrella seal 15 inverts and homes against the conical sealing surface 19(e).

When the wash action in the dishwasher is initiated, water accumulates in the annular groove 23 around the outer periphery of the adapter 21 and flows down through the plurality of holes 21c into the housing 22 encompassing the float 13. As the water level inside of the housing 22 rises, the float 13 begins to rise to an intermediate position, as shown in FIG. 1. In the intermediate position, the upper seal 14 forms a seal around the sealing surface 20a and the bottom seal 15 continues to create a seal around the sealing surface 19e. The inner cavity 19a forms a measuring chamber defined at its top by the top seal 14, at its bottom by the bottom seal 15 and around the sides by the inner wall of the third cylinder 19.

Figure 3:
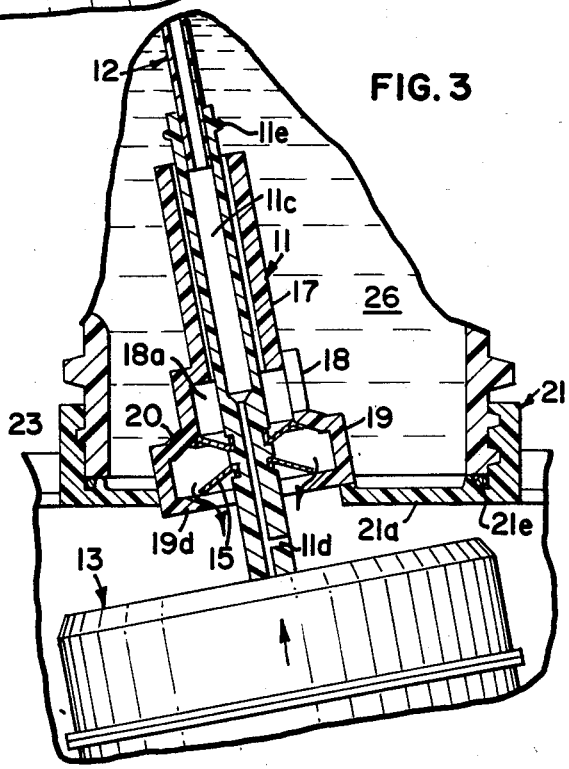
FIG. 3 is a partial cross-sectional view of the dispenser of FIG. 1 shown in the dispensing mode.

As the water level continues to rise in the housing 22, the float continues to rise, moving the float assembly 13, along with a plunger 11 to its dispensing position, as shown in FIG. 3. In this position, the upper seal 14 is inverted against the sealing surface 20a and the lower umbrella seal 15 is moved away from the sealing surface 19e, thereby allowing a fixed charge of product, that is in the measuring chamber, to be expelled through the bottom opening 19c. Upon the completion of the wash action in the dishwasher, the accumulated water and product in the housing 22 is allowed to slowing drain through the opening 22d. This allows the float 13 to drop slowly, thereby repeating the process, allowing the measuring chamber to be recharged for the next part of the cycle. The liquid dispenser 10 is placed such that the level of water in the dishwasher does not rise to the bottom of the housing 22. Therefore, the opening 22d is always allowing either water or water and product to be dispensed while the washing action is taking place.

As the dispenser 10 is being cycled, air is allowed to enter the bottle 25 by means of the venting system. Air goes in through the extension opening 11d and up through the bore 11c and the venting tube bore 12a. This allows air to replace the product 26 that has been dispensed, thereby preventing the plastic bottle 25 from collapsing.

In a preferred embodiment, the plunger housing 16 is secured to the base plate 21a at an angle. By having the inner cavity 19a at an angle to the horizon, viscous fluid products more easily enter and exit the openings.

The stop 11e prevents the float 13 from carrying the plunger 11 too far in the downward direction. It is understood that the stiffness of the elastomeric seals 14 and 15 can be varied depending upon the amount of force that is required or desired by the design of the float 13.

Other modifications of the invention will be apparent to those skilled in the art in light of the foregoing description. This description is intended to provide specific examples of individual embodiments which clearly disclose the present invention. Accordingly, the inventions are not limited to these embodiments or the use of elements having specific configurations and shapes as presented herein. All alternative modifications and variations of the present invention which follow in the spirit and broad scope of the appended claims are included.

What is claimed is:

1. A liquid dispenser for dispensing a constant volumetric quantity of liquid, said dispenser comprising:

(a) a plunger having a longitudinal axis;

(b) first and second substantially elastic umbrella seals cooperatively connected to said plunger, said seals in a spaced relationship;

(c) a plunger housing enclosing at least a portion of said plunger, said plunger housing adapted for relative movement with said plunger along said longitudinal axis, said plunger housing having an inner cavity having a first and a second opening, said inner cavity having a first and second sealing surface at said first and second openings, said seals positioned in said inner cavity, wherein a measuring chamber which holds a constant volume of liquid is defined between said seals, said first opening in fluid communication with the liquid to be dispensed, said first seal controlling fluid communication between said first opening and said measuring chamber and said second seal controlling fluid communication between said measuring chamber and said second opening;

(d) means for effecting relative movement along said longitudinal axis between said plunger and said plunger housing, said means comprising:

(i) a float cooperatively connected to said plunger; and (ii) a housing having an inner cavity, wherein said plunger moves from a filling position to a dispensing position, wherein when in said filling position said second seal effects a liquid tight seal with said second sealing surface of said second opening and said first seal allows liquid to enter said measuring chamber through said first opening and when in said dispensing position said first seal effects a liquid tight seal with said second sealing surface of said first opening and said second seal allows liquid to be dispensed by gravity from said second opening, said first seal always in a sealing relationship to said first opening when said second seal allows dispensing of liquid, whereby a constant volume of liquid is dispensed;

(e) said plunger housing comprises an upper portion having an inner bore sized larger than said plunger, wherein said upper portion acts as a guide for relative movement of said plunger and a seal is not effected between said plunger and said plunger housing;

(f) said first and second sealing surfaces at said first and second openings are conical;

(g) said seals having an opening proximate their center, said opening sized smaller that an outer dimension of said plunger where said seals are cooperatively connected, wherein a liquid tight seal is formed between said plunger and said seals;

(h) said plunger having annular grooves around which said seals are positioned, said grooves having a width that is substantially filled by said seals;

(i) said plunger having a bore with a first and second opening, said first opening cooperatively connected to a vent tube and said second opening in communication with atmospheric air;

(j) a stop cooperatively connected to said plunger to limit downward movement of said plunger;

(k) an adapter having an opening in which said plunger housing is cooperatively connected, said adapter having means for securing a container in which the liquid to be dispensed is contained; and (l) said plunger housing is cooperatively connected to said adapter at an angle, wherein said plunger housing is at an angle with the horizontal when in use.

* * * * *